United States Patent [19]

Larsson et al.

[11] Patent Number: 4,961,469

[45] Date of Patent: Oct. 9, 1990

[54] DRILL STRING ELEMENT

[75] Inventors: Kenneth L. Larsson; Sven P. Liljebrand, both of Sandviken, Sweden

[73] Assignee: Sandvik AB, Sandviken, Sweden

[21] Appl. No.: 341,819

[22] Filed: Apr. 24, 1989

[30] Foreign Application Priority Data

Apr. 26, 1988 [SE] Sweden ..... 8801535

[51] Int. Cl.[5] ..... E21B 3/00

[52] U.S. Cl. ..... 173/163; 173/132; 173/104; 175/293

[58] Field of Search ..... 173/163, 164, 78, 13–17, 173/104, 132; 175/293

[56] References Cited

U.S. PATENT DOCUMENTS

| | | | |
|---|---|---|---|
| 2,636,753 | 4/1953 | Griffin . | |
| 3,011,570 | 12/1961 | Kurt et al. . | |
| 4,094,364 | 6/1978 | Lundstrom et al. . | |
| 4,194,581 | 3/1980 | Walter | 173/78 X |

FOREIGN PATENT DOCUMENTS

| | | |
|---|---|---|
| 0197019 | 10/1986 | European Pat. Off. . |
| 1267184 | 7/1961 | Fed. Rep. of Germany . |
| 1223674 | 1/1960 | France . |
| 1559437 | 1/1980 | United Kingdom . |

*Primary Examiner*—Douglas D. Watts
*Assistant Examiner*—Willmon Fridie, Jr.
*Attorney, Agent, or Firm*—Burns, Doane, Swecker & Mathis

[57] ABSTRACT

A drill string element for use in top hammer percussive drilling comprises first and second tubes coupled together by a cylindrical thread, and at least one impact-transmitting ord slidably disposed in the tubes. The rod(s) includes abutments which engage restrictions formed at remote ends of the tubes whereby the rod(s) can be removed only by unscrewing the tubes from one another. Remote ends of the tubes define male and female conical threads which enable the element to be connected to similar elements in the forming of a drill string. The conical threads are easier to unscrew than the cylindrical threads to avoid an accidental separation of the tubes of each element when that element is being unscrewed from another element.

9 Claims, 3 Drawing Sheets

FIG 5
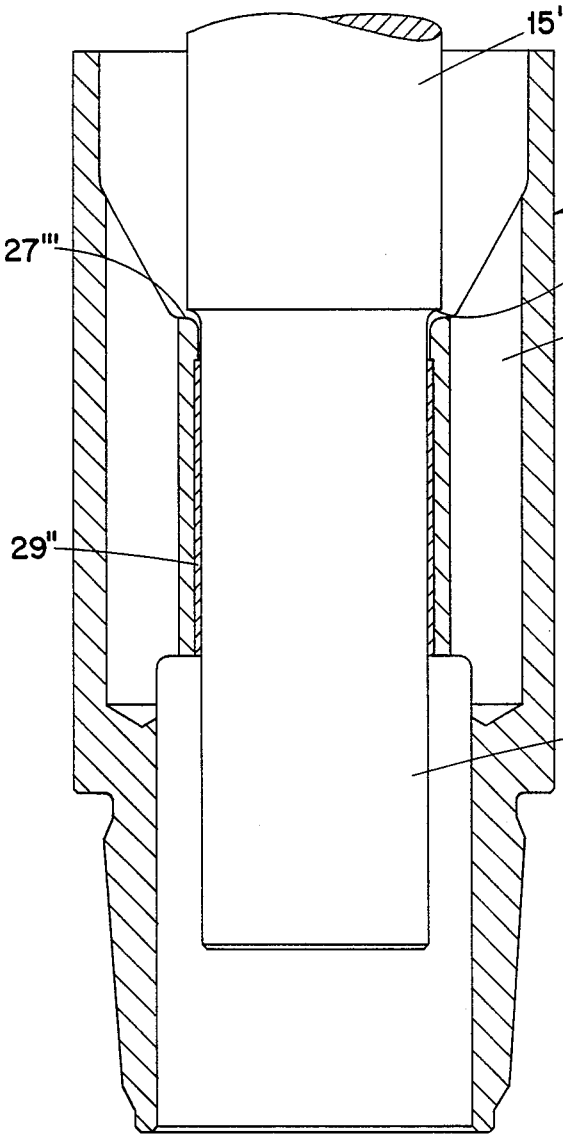
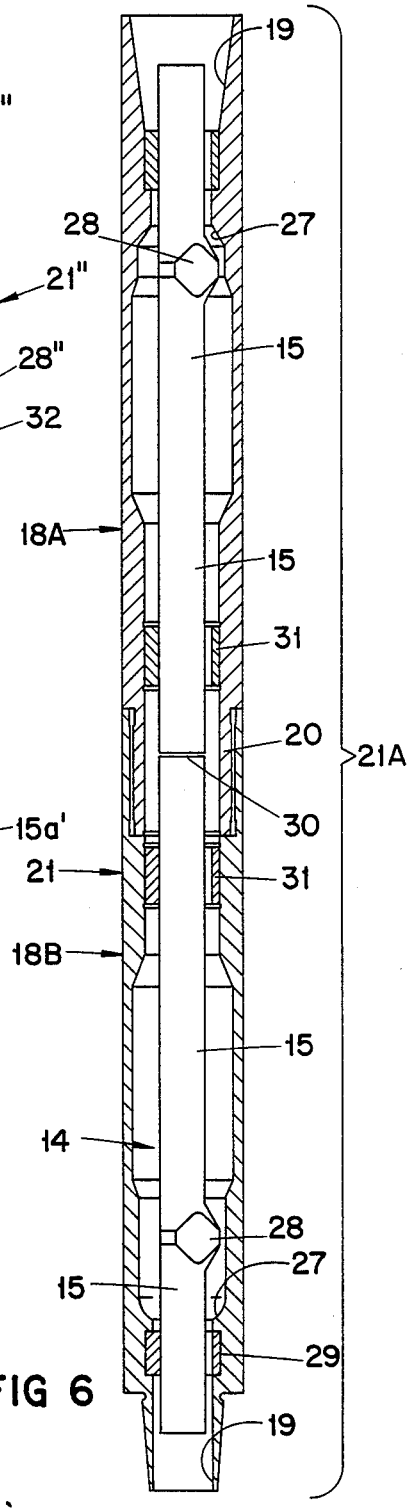
FIG 6

DRILL STRING ELEMENT

BACKGROUND AND OBJECT OF THE INVENTION

The present invention relates to a drill string element adapted to be coupled to other similar drill string elements by thread connections thus forming a drill string for top hammer drilling. Each drill string element includes at least one rod for transferring impact energy to a drill bit provided at the lower end of the drill string and a tube assembly for transferring rotation to the drill bit, the tube assembly surrounding the rod. The invention also relates to a tubular member adapted to be included in a drill string element according to the invention.

Drill string elements of the above-mentioned type are previously known from U.S. Pat. No. 4,094,364. However, these drill string elements have the disadvantage that when they are separated from each other by unscrewing the thread connections in question the rod can fall out of the surrounding tube assembly in one direction. This is a considerable disadvantage in respect of handling, especially regarding workers' protection. However, the wanted characteristic of having the rod safely secured within the tube assembly must be combined with a necessary accessibility to the interior of the drill string element, e.g. in connection with service or repair. Also the tube assemblies must be kept intact at normal handling during operation.

The present invention has the aim of presenting a drill string element of the above-mentioned kind having a rod that is safely secured within the tube assembly and also having good accessibility in connection with service/repairs.

THE DRAWINGS

Figure 1:
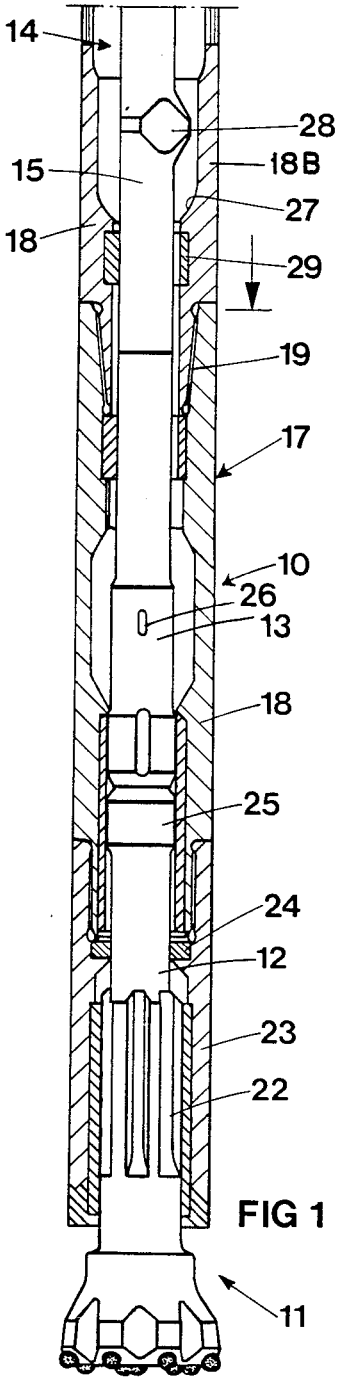
Figure 2:
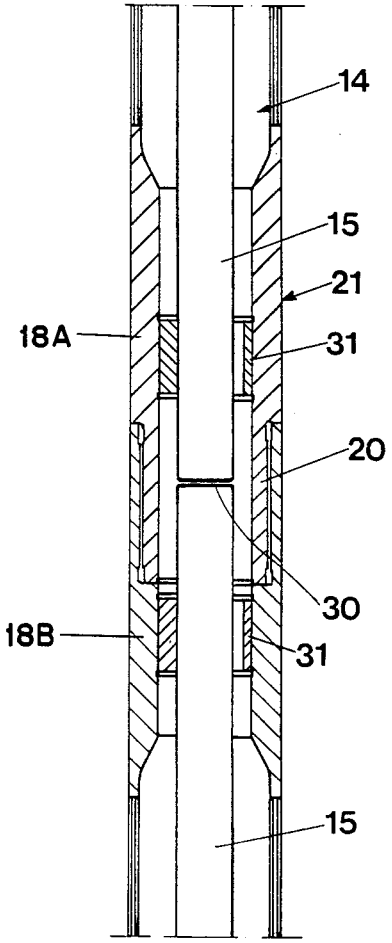
Figure 3:
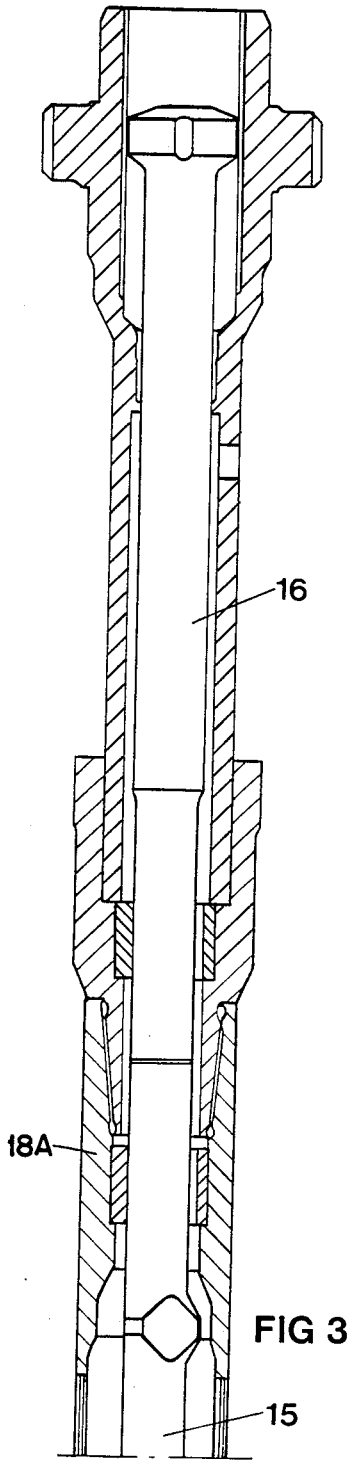
Figure 4:
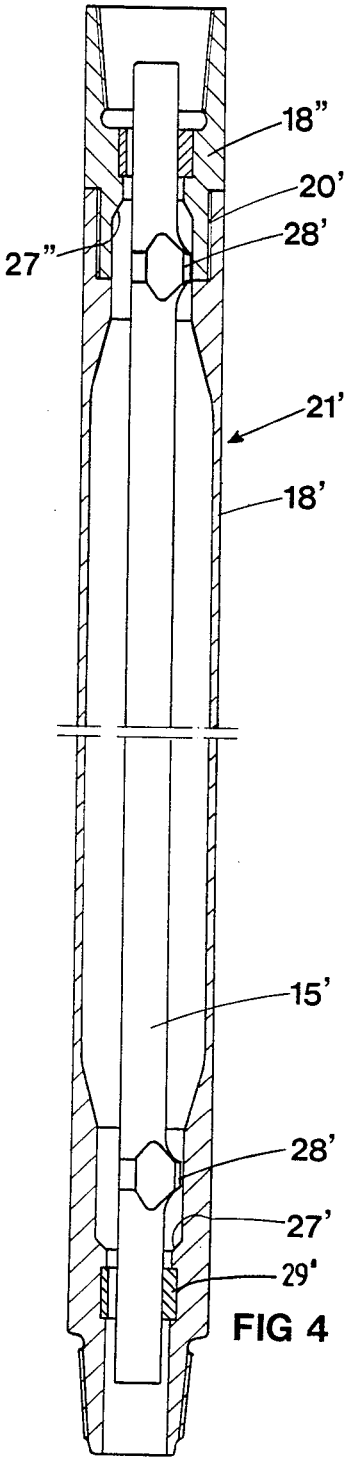

Below an embodiment of the invention will be described, reference being made to the accompanying drawings:

FIG. 1 shows a partly sectioned side view of a lower portion of a drill string including drill string elements according to the present invention; FIG. 2 shows a partly sectioned side view of an intermediate portion of a drill string element according to the invention; FIG. 3 shows a partly sectioned side view of an upper portion of a drill string including drill string elements according to the present invention; FIG. 4 shows an alternative embodiment of a drill string element according to the invention especially adapted for shorter rods; FIG. 5 shows an alternative embodiment for means to prevent the rod of a drill string element to fall out of said drill string element; and FIG. 6 is a longitudinal sectioned view through one of the drill string elements of the type containing two rods.

BACKGROUND OF A PREFERRED EMBODIMENT OF THE INVENTION

In FIGS. 1–3 a drill string 10 is shown, the drill string 10 including a drill bit 11 comprising two parts 12 and 13. On top of the drill bit 11 a central set of rods 14 is resting, said set including a number of rods 15 that have their ends loosely abutting each other. The uppermost rod 15 in the set 14 carries a top hammer 16 that transfers impacts to the drill bit 11 via the set of rods 14. The drill string 10 further includes a set of tubes 17 that surrounds the set of rods 14, said set of tubes 17 including a number of tubular members 18 that are secured to each other by thread connections. As is apparent from FIGS. 1–3 the thread connections are of two different types, i.e. every other thread connection is conical and the rest of the thread connections are cylindrical. The reason for using two different types of thread connections is that by doing so one normally can predict which thread connection will unscrew first since conical thread connections 19 generally are easier to loosen than cylindrical thread connections 20. This means that the drill string elements 21A that the operator normally handles consist of one or more rods 15 and two tubular members 18A, 18B forming a tube assembly 21 having conical threads ends. The cylindrical thread connection 20 is unscrewed in principle only when the rods 15 are to be mounted within the tubular members 18A, 18B or when repair or service of the equipment need to be done.

The aim of the set of tubes 17 is to transfer rotation to the drill bit 11. For this purpose the drill bit 11 and the frontal end of the set of tubes 17 are provided with cooperating splines 22. The splines of the set of tubes 17 are provided in a bit sleeve 23 that via a cylindrical thread connection 20 is coupled to the rest of the set of tubes 17. The bit sleeve 23 is unscrewed when the lower part 12 of the drill bit 11 is replaced. This happens quite often since it constitutes a wear part of the drill string 10. The lower part 12 of the drill bit 11 is prevented from falling out of the drill string 10 by a stop ring 24 that cooperates with an enlarged portion 25 of the lower part 12.

The upper part 13 of the drill bit 11 is provided with a flushing channel 26 extending transverse to the longitudinal direction of the drill bit 11, said flushing channel 26 communicating with one or more internal flushing channels in the drill bit 11. From the flushing channel 26 and upwards there is a space between the set of rods 14 and the set of tubes 17, said space transporting the flushing air from the ground level.

As is apparent from FIGS. 1–3 the tubular members 18 are provided with an internal diameter reduction 27 in connection with the conical thread connections 19, said diameter reduction being so dimensioned that it cooperates with a radial projection 28 of the associated rod 15 to prevent the rod 15 from falling out of the tube assembly 21 during its handling. Each tubular member 18 is provided with an internal diameter reduction 27 in connection with both the male and female part of the conical thread connection 19. This guarantees that an associated rod 15 is prevented from falling out of the tube assembly 21 at both ends of said assembly 21.

In connection with the conical thread connection 19 the tubular members 18 are provided with a guide means 29 for the rod 15, said guide means 29 preferably being of flexible material, e.g. polyurethane, thereby reducing vibrations and noise of the device and simultanously compensating for a certain lack of straightness of the rods 15.

As is apparent from FIG. 2 a joint 30 between two rods 15 is arranged at the level of the cylindrical thread connection 20 in the disclosed embodiment. The reason therefor is that the rods 15 thereby have a length that can be handled. The tubular members 18 are provided with guide means 31 in connection with the joint 30 regardless whether it is a male or female part. The guide means 31 have the corresponding function as the guide means 29 described above and preferably the guide devices 31 are made out of the same material. The length of a tube assembly 21 between two conical thread connections 19 of the structural design described above is 3–6 m. In the area of the lower limit of the interval it is possible to have the rod 15 in one piece provided that the guide means 29 can be mounted properly.

The embodiment disclosed in FIG. 4 is especially adapted for tube assemblies 21' of shorter length, and consequently only one rod 15' is mounted within the tube asssembly 21'. The tubular members 18' and 18'' have in this case a substantially different length. This means that the cylindrical thread connection 20' is located in connection with one end of the tube assembly 21'. In accordance with the embodiment described above both the tubular members 18' and 18'' have internal diameter reducings 27' and 27'' that cooperate with radial projections 28' of the rod 15'.

In FIG. 5 an alternative embodiment concerning means to prevent the rod 15'' from falling out of the tube assembly 21'' is shown. In the area of its free ends the rod 15'' has portions **15*a*'' of a reduced diameter. The transition between said portion 15*a*'' and the rest of the rod 15'' is defined by shoulder means 28'' extending circumferentially around the rod 15''. The shoulder means 28'' cooperate with a diameter reducing 27''' to prevent the rod 15'' from falling out downwards in FIG. 5. The reduced diameter portion 15*a*'' is guided by guide means 29'' of preferably flexible material. The flushing medium is discharged in channels 32 located radially outside of the guide means 29''**.

Within the scope of the invention it is also possible that each tube assembly holds three or more rods if the length of the tube assembly is extremely large, e.g. towards about 11 m.

The above described embodiments refer to solid rods 15;15';15'' and consequently the flushing medium passes between the tubular members 18;18';18'' and the rods 15;15';15''. However, the invention is also applicable for rods having internal, longitudinal flushing channels.

It is in no way necessary that one thread connection 19 is conical while the other thread connection 20 is cylindrical. The important feature is that the thread connections are unequally easy to unscrew and this can e.g. be achieved by different pitches of the respective thread connections.

Also in other aspects the invention is in no way limited to the embodiments described above but can be varied freely within the scope of the appending claims.

We claim:

1. A drill string element adapted to be connected to similar drill string elements for forming a drill string to be used in top hammer percussive drilling, said drill string element comprising a tube assembly and impact-transmitting rod means disposed within said tube assembly, said tube assembly being adapted to transmit rotary motion to a drill bit in a drill string and said impact-transmitting rod means being adapted to transmit percussive impact energy to the drill bit, said tube assembly comprising at least first and second coaxial tubular members threaded together in end-to-end relationship by a first type of screw thread, said tubular members defining axially opposite first and second ends, respectively, of said tube assembly, said first end of said tube assembly carrying a male section of a second type of screw thread, said second end of said tube assembly carrying a female section of said second type of screw thread, said tube assembly including internal surface means forming an inner space, said internal surface means forming first and second restrictions of reduced cross section situated adjacent to and spaced axially inwardly of said first and second ends, respectively, of said tube assembly, said impact-transmitting rod means being freely slidably disposed within said space and arranged coaxially with said tube assembly, said impact-transmitting rod means including axially opposite first and second ends situated axially outwardly of said first and second restrictions, respectively, said impact-transmitting rod means including first and second radial abutments situated adjacent to and axially inwardly of said first and second restrictions, respectively, said first and second restrictions being sized to engage said first and second radial abutments, respectively, to prevent axial passage of said impact-transmitting rod means, whereby said rod means is removable from said tubular members only upon unscrewing of said tubular members from one another, said first type of screw thread being of a type which is harder to unscrew than said second type of screw thread.

2. Drill string element according to claim 1, wherein said tubular members include guide means disposed in said internal surface adjacent said first and second ends of said tube assembly for axially slidably guiding said impact-transmitting rod means.

3. Drill string element according to claim 2, wherein said guide means are formed of a flexible material.

4. Drill string element according to claim 2, wherein said guide means include slots extending completely therethrough for conducting flushing medium traveling within said space.

5. Drill string element according to claim 1, wherein said impact-transmitting rod means comprises first and second rods arranged end-to-end, said first rod carrying said first radial abutment and defining said first end of said rod means, said second rod carrying said second radial abutment and defining said second end of said rod means.

6. Drill string element according to claim 5, wherein said tubular members include guide means disposed in said internal surface adjacent the site where said rods engage one another for axially slidably guiding said rods.

7. Drill string element according to claim 6, wherein said guide means are formed of a flexible material.

8. Drill string element according to claim 6, wherein said guide means include slots extending completely therethrough for conducting flushing medium traveling within said space.

9. Drill string element according to claim 1, wherein said first type of screw thread comprises a cylindrical screw thread, and said second type of screw thread comprises a conical screw thread.

* * * * *